US006503152B1

(12) United States Patent
Pelz

(10) Patent No.: US 6,503,152 B1
(45) Date of Patent: Jan. 7, 2003

(54) PUTTING TRAINER

(76) Inventor: David T. Pelz, 1310 Ranch Road 620, S., Suite B-1, Austin, TX (US) 78734

( * ) Notice: Subject to any disclaimer, the term of this patent is extended or adjusted under 35 U.S.C. 154(b) by 0 days.

(21) Appl. No.: 09/898,361

(22) Filed: Jul. 5, 2001

(51) Int. Cl.[7] ..... A63B 69/36
(52) U.S. Cl. ..... 473/257; 473/157
(58) Field of Search ..... 473/257, 262, 473/264, 265, 278, 266, 268, 218, 279, 267, 240, 150, 220, 185, 252, 158, 162, 163, 171, 181, 160, 161, 174

(56) References Cited

U.S. PATENT DOCUMENTS 1,484,064 A * 2/1924 Erickson et al.
1,783,211 A * 12/1930 Baldwin
2,461,601 A * 2/1949 Hendricks
2,710,757 A * 6/1955 Chong
2,712,939 A * 7/1955 Harp
3,312,474 A 4/1967 Mitchell ..... 273/186
3,868,109 A * 2/1975 Fowler
3,934,882 A 1/1976 Whittaker ..... 273/183 A
D293,261 S * 12/1987 Sadowski
4,765,625 A * 8/1988 Miner
4,826,174 A 5/1989 Hoyt, Jr. ..... 273/186 R
4,913,440 A * 4/1990 Ellington
4,953,865 A 9/1990 Coombs et al. ..... 273/176 F
4,988,105 A * 1/1991 Perry et al.
5,042,814 A * 8/1991 Bennett
5,351,962 A 10/1994 Lin ..... 273/186.2
5,409,231 A 4/1995 Kueng et al. ..... 273/176 FB
5,413,344 A 5/1995 Darden ..... 273/176 E
5,527,041 A 6/1996 Terry, III et al. ..... 473/150
5,595,543 A 1/1997 Wolk ..... 473/162
5,628,694 A 5/1997 O'Connor, Jr. ..... 473/157
5,725,438 A * 3/1998 Dennesen
5,910,053 A 6/1999 Scalise ..... 473/257
6,019,685 A 2/2000 Fonseca et al. ..... 473/265
6,159,106 A * 12/2000 Adams

* cited by examiner

*Primary Examiner*—Paul T. Sewell
*Assistant Examiner*—Nini F. Legesse
(74) *Attorney, Agent, or Firm*—Welsh & Flaxman LLC

(57) ABSTRACT

The putting trainer includes a substantially flat plate upon which a golfer may place and strike a golf ball. The plate includes a first end having a recess shaped and dimensioned for receiving a golf ball and maintaining the golf ball in position adjacent the first end until such a time that the golfer strikes the golf ball toward a second end of the plate. The plate further includes a central alignment groove extending from the recess toward the second end of the plate. The putting trainer also includes a plurality of obstacles respectively and selectively positioned within a plurality of indents formed within the plate. The indents are positioned on opposite sides of the central alignment groove to define a passageway through which a golf ball is desirably struck.

15 Claims, 5 Drawing Sheets

PUTTING TRAINER

BACKGROUND OF THE INVENTION

1. Field of the Invention

The invention relates to a putting trainer. More particularly, the invention relates to a putting trainer including an aiming plate having features which enhance a golfer's ability to train him or her self to strike a golf ball in a precisely square and straight manner in an accurately predetermined direction.

2. Description of the Prior Art

Golfers are continually attempting to improve their putting strokes and many devices have been developed in an effort to help golfers in this endeavor. However, no one training device has fulfilled the needs of all golfers, and new training devices are continually being developed in an effort to provide golfers with improved and interesting training techniques. The present putting trainer attempts to provide golfers with a previously unknown training device offering golfers an interesting and effective method for practicing and improving their putting strokes.

SUMMARY OF THE INVENTION

It is, therefore, an object of the present invention to provide a putting trainer. The putting trainer includes a substantially flat plate upon which a golfer may place and strike a golf ball. The plate includes a first end having a recess shaped and dimensioned for receiving a golf ball and maintaining the golf ball in position adjacent the first end until such a time that the golfer strikes the golf ball toward a second end of the plate. The plate further includes a central alignment groove extending from the golf ball recess toward the second end of the plate, the central alignment groove providing a desired alignment direction for a golfer striking a golf ball sitting within the recess. The putting trainer also includes a plurality of obstacles respectively and selectively positioned within a plurality of indents formed within the plate. The indents are positioned on opposite sides of the central alignment groove at a position between the recess and the second end of the plate to define a passageway through which a golf ball is desirably struck as a golfer attempts to hit the golf ball from the first end of the plate toward the second end of the plate, wherein the indents are shaped and dimensioned such that obstacles placed therein are readily dislodged when a struck golf ball veers from the central alignment groove and strikes one of the obstacles.

It is also an object of the present invention to provide a putting trainer wherein the plurality of obstacles are balls.

It is a further object of the present invention to provide a putting trainer wherein the plurality of indents are dimples respectively shaped and dimensioned to receive the balls.

It is another object of the present invention to provide a putting trainer wherein the first end includes a first edge adjacent the recess, the recess being positioned relative to the first edge such that a rear edge of a golf ball sitting within the recess is aligned with the first edge, allowing a golfer to align a putter with the first edge as the golfer addresses the golf ball prior to putting.

It is still another object of the present invention to provide a putting trainer wherein the recess is approximately 0.84 inches from the rear edge.

It is yet a further object of the present invention to provide a putting trainer wherein the central alignment groove is visible to a golfer standing over the plate.

It is also an object of the present invention to provide a putting trainer wherein the first edge includes an open cut section extending from the first edge toward the golf ball recess. The open cut section is defined by opposed upwardly inclined walls such that a ball rolled within the open cut section toward the recess will roll up the opposed upwardly inclined walls and into the recess.

It is another object of the present invention to provide a putting trainer wherein the opposed upwardly inclined walls angle toward each other as they extend from the first edge toward the recess.

It is a further object of the present invention to provide a putting trainer wherein the opposed upwardly inclined walls define a substantially V-shaped open cut section.

It is also a further abject of the present invention to provide a putting trainer including a substantially flat plate upon which a golfer may place and strike a golf ball. The plate includes a first end having a recess shaped and dimensioned for receiving a golf ball and maintaining the golf ball in position adjacent the first end until such a time that the golfer strikes the golf ball toward a second end of the plate. The plate further includes a positioning stake extending downwardly from an underside of the plate adjacent the first end of the plate, wherein the stake is positioned in alignment with the recess to allow the plate to be readily rotated about the stake and recess when a golfer wishes to realign a putting direction.

It is yet a further object of the present invention to provide a putting trainer including a pair of alignment cams shaped and dimensioned for positioning adjacent the plate for selectively and securely orienting the plate.

It is still another object of the present invention to provide a putting trainer wherein each alignment cam includes a circular body and a centrally offset, downwardly extending stake.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

Figure 1:
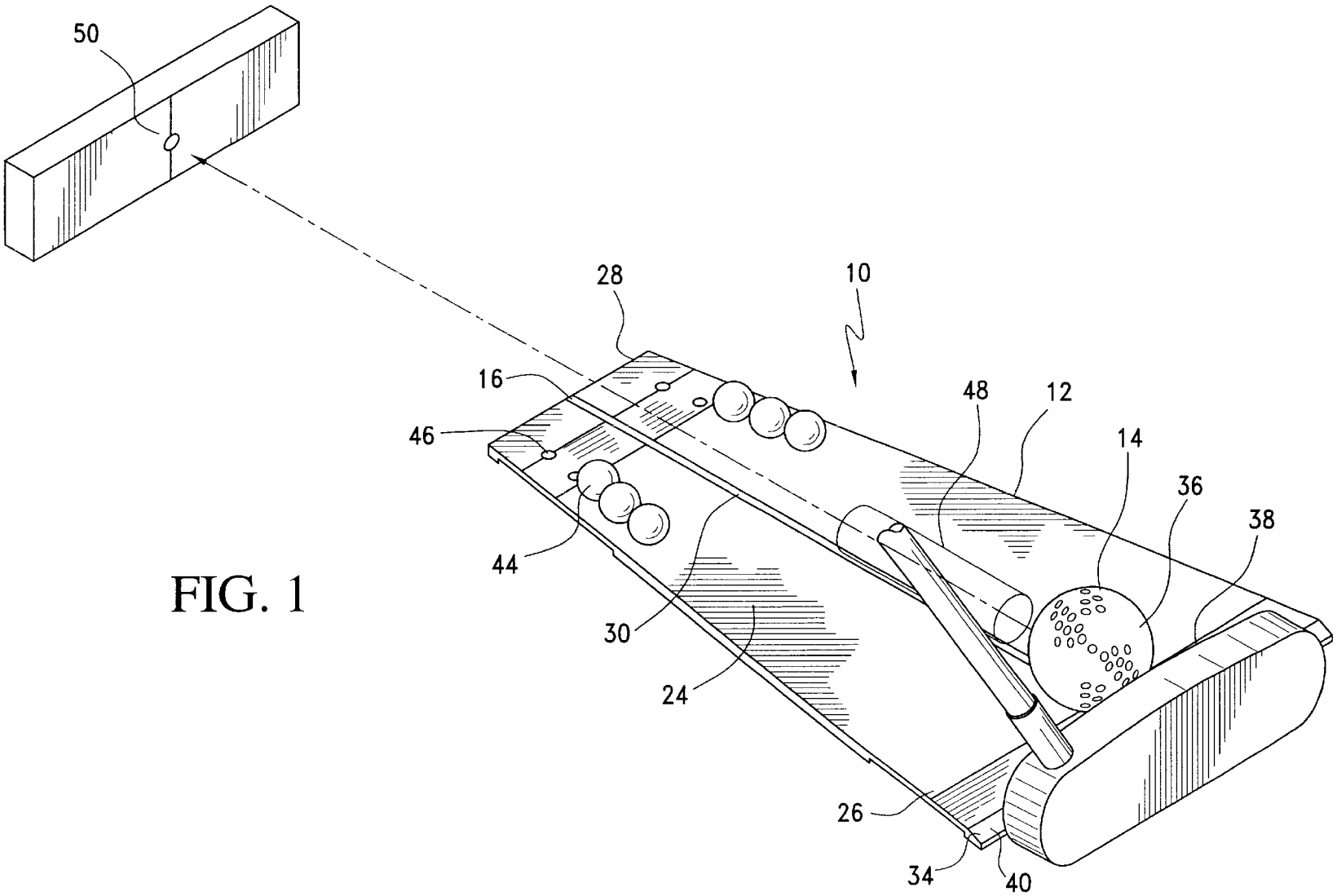
FIG. 1 is a perspective view of the present putting trainer.
Figure 2:
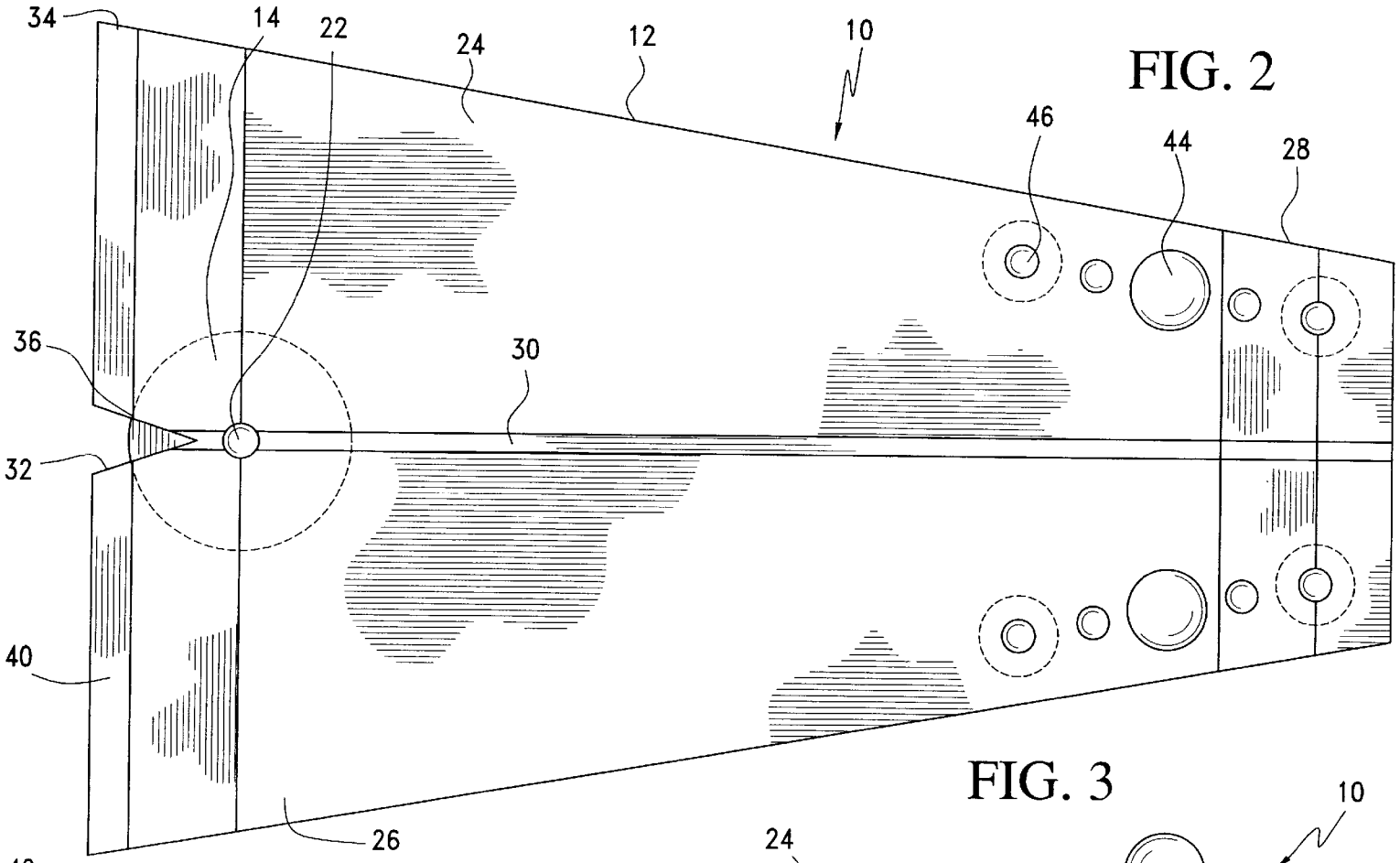
FIG. 2 is a top view of the putting trainer.
Figure 3:
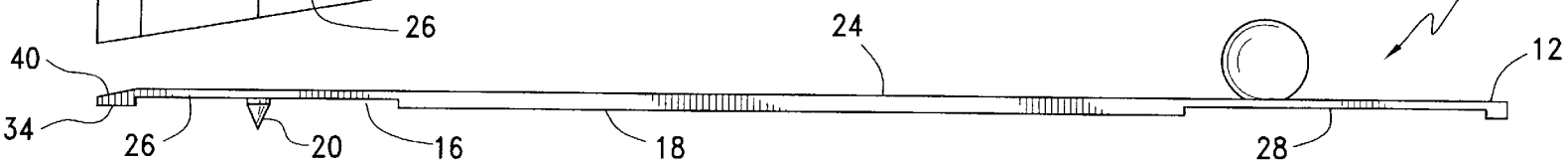
FIG. 3 is a side view along the side edge of the putting trainer.
Figure 4:
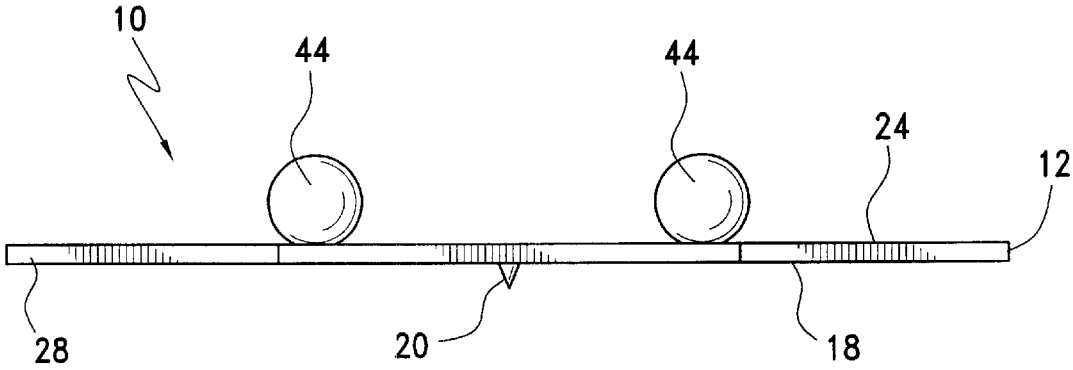
FIG. 4 is a side view along the front edge of the putting trainer.
Figure 5:
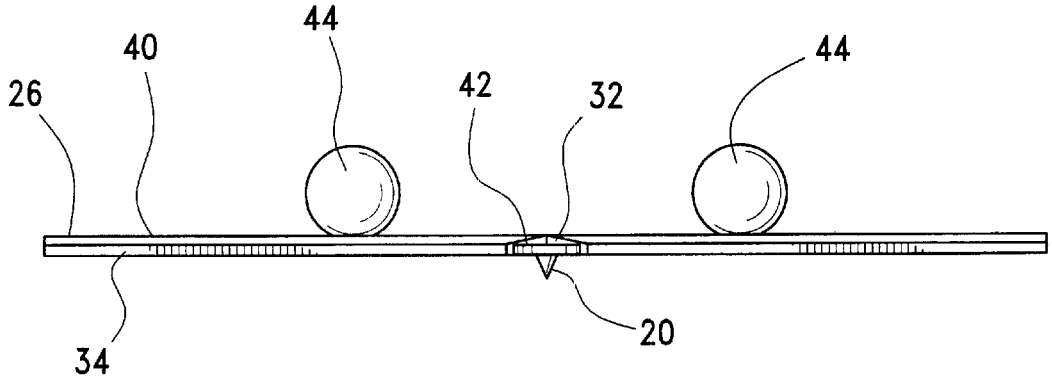
FIG. 5 is a side view along the rear edge of the putting trainer.
Figure 6:
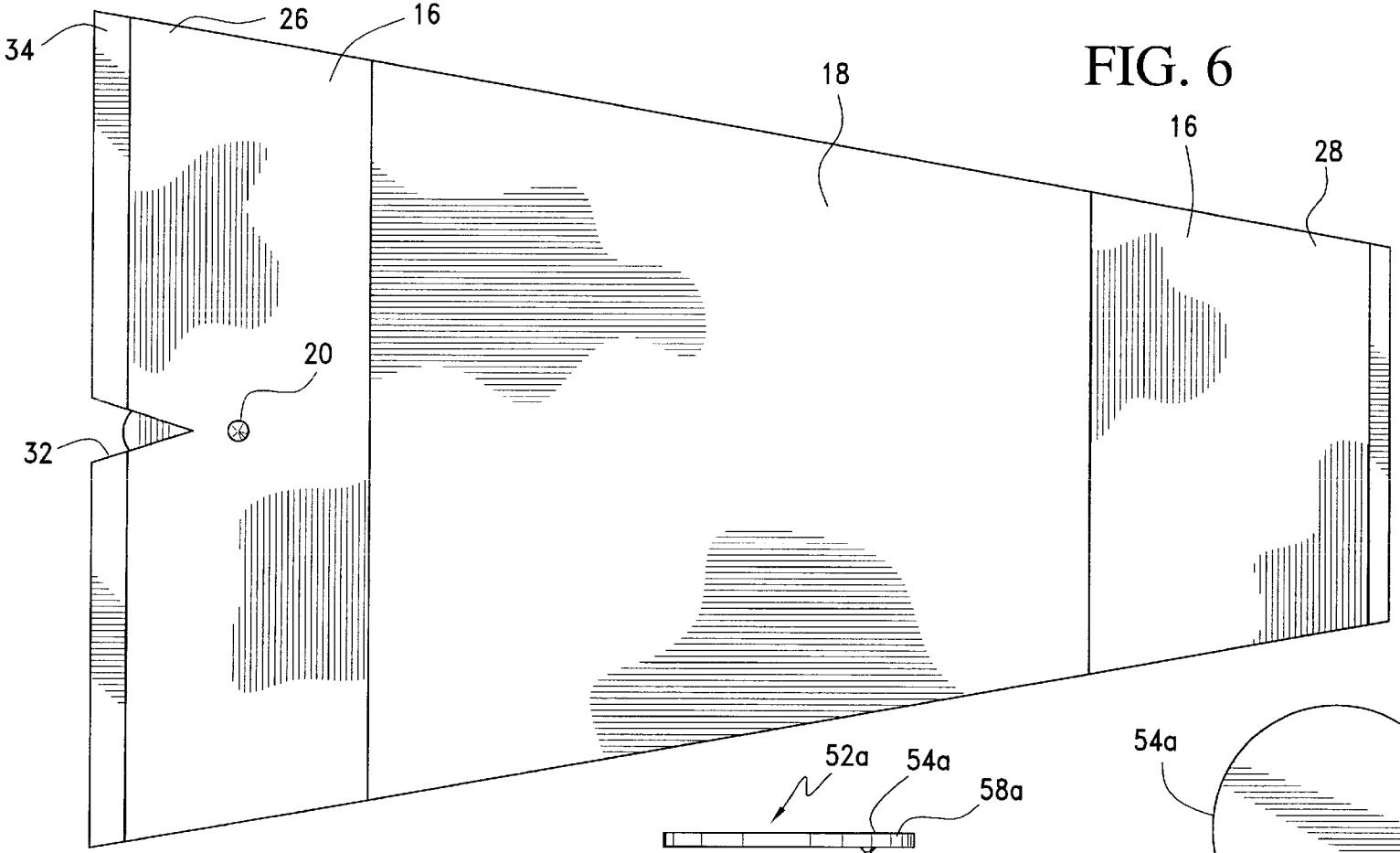
FIG. 6 is a bottom view of the putting trainer.

The detailed embodiments of the present invention are disclosed herein. It should be understood, however, that the disclosed embodiments are merely exemplary of the invention, which may be embodied in various forms.

Therefore, the details disclosed herein are not to be interpreted as limited, but merely as the basis for the claims and as a basis for teaching one skilled in the art of how to make and/or use the invention.

With reference to FIGS. 1 to 6, a putting trainer 10 in accordance with the present invention is disclosed. The putting trainer 10 includes a substantially flat plate 12 upon which a golfer may place and strike a golf ball 14. The plate 12 is preferably formed of polycarbonate and has a thickness of 0.093 inches. The plate 12 is further provided with recesses 16 along its underside 18 in which inserts may be positioned for advertising the origin of the putting trainer 10 or providing golfers with instructions regarding the use of the putting trainer 10. While specific materials and dimensions are disclosed above with reference to the present putting trainer, those skilled in the art will appreciate the possible variations in material, thickness, shape, etc. that may be made without departing from the spirit of the present invention. For example, it is contemplated that the plate may be manufactured from aluminum or other break-resistant materials of different weights.

As mention above, the plate 12 includes an underside 18. The underside 18 is provided with a downwardly extending stake 20. The stake 20 is shaped and dimensioned to facilitate secure location of the present putting trainer 10 to an underlying support structure (such as a putting green or an indoor room carpet). The stake 20 is generally positioned directly below a golf ball supporting recess 22, thereby allowing the plate 12 to be readily rotated about the stake 20 when a golfer wishes to realign the putting trainer 10. The plate 12 further includes a topside 24, a first end 26 and a second end 28.

The first end 26 of the plate 12 includes a centrally positioned golf ball supporting recess 22 shaped and dimensioned for receiving a golf ball 14 and maintaining the golf ball 14 in position adjacent the first end 26 until such a time that the golfer strikes the golf ball 14 toward the second end 28 of the plate 12. The topside 24 of the plate 12 further includes a central alignment groove 30 extending from the recess 22, and the open cut section 32 (to be discussed below in greater detail), toward the second end 28 of the plate 12. The central alignment groove 30 provides a desired straight-line starting direction for a golfer striking a golf ball 14 sitting within the recess 22 and is preferably formed to be readily visible to a golfer standing over the present putting trainer 10. In addition, the alignment groove 30 is readily visible to a golfer both from behind the plate (to help in setting the plate precisely in proper alignment on a putting surface) and from above (to help a golfer learn proper appearance of desired putting direction line from actual putting position).

With the foregoing in mind, the central alignment groove 30 is painted white to enhance visibility. However, other colors (for example, red, yellow or other "stand-out" colors) may be used without departing from the spirit of the present invention. In addition, those skilled in the art will certainly appreciate that painting of the groove may be replaced with other coloring techniques, for example, tape.

In accordance with a preferred embodiment of the present invention, the alignment groove 30 is milled to a depth of 0.05 inches with a width of 0.109 inches. However, these dimensions are merely used in accordance with a preferred embodiment of the present invention, and other dimensions may certainly be used without departing from the spirit of the present invention.

As discussed above, the recess 22 is shaped and dimensioned for receiving and maintaining a golf ball 14 in position adjacent the first end 26 of the plate 12. The recess 22 is positioned in line with the alignment groove 30 and, as such, is centrally positioned on the present plate 12. The functionality of the present putting trainer 10 is further enhanced by positioning the recess 22 at a specific distance from the first edge 34 of the first end 26. Specifically, the recess 22 is positioned relative the first edge 34 such that a rear edge 36 of a golf ball 14 sitting within the recess 22 is aligned with the first edge 34. Since the first edge 34 is substantially perpendicular to the central alignment groove 30 along which a golfer attempts to hit a golf ball 14 in accordance with the present invention, the positioning of the recess 22 a predetermined distance from the first edge 34 allows a golfer to align a putter face 38 with the first edge 34 as the golfer addresses the golf ball 14 prior to putting. In this way, a golfer may square the face 38 of the putter along the first edge 34 to ensure a proper set up prior to beginning his or her putting stroke.

Since a golf ball is approximately 1.68 inches in diameter, it is preferred that the center of the recess 22 be positioned a distance of 0.84 inches from the first edge 34. However, this distance may be varied slightly where different diameter golf balls are used for various purposes. Similarly, those skilled in the art will appreciate that the recess may be moved further from or closer to the first edge where a specific training technique so dictates.

Use of the first edge 34 as an alignment mechanism is further facilitated by beveling the first edge 34 of the plate 12 as the topside 24 extends toward the underside 18 of the plate 12. The bevel provides for a smooth transition between the underside 18 and the topside 24 of the plate 12, allowing a golfer to smoothly strike a golf ball 14 with a putter without worrying that the putter will strike a flush edge. In addition, the beveled edge of the first edge 34 is colored white to enhance visibility and provide golfers with a readily visible mark by which he or she may align the face of a putter.

As mentioned above, the first edge 34 also includes an open cut section 32 extending from the first edge 34 toward the recess 22. The open cut section 32 is defined by opposed upwardly inclined walls 42 such that a ball 14 rolled within the open cut section 32 toward the recess 22 will roll up the opposed upwardly inclined walls 42 and into the recess 22. In accordance with a preferred embodiment of the present invention, the opposed upwardly inclined walls 42 angle toward each other as they extend from the first edge 34 toward the recess 22, defining a substantially V-shaped open cut section 32.

A plurality of obstacles 44 are respectively positioned within a plurality of indents 46 shaped and dimensioned for receiving the obstacles 44. The indents 46 are positioned on opposite sides of the central groove 30 at a position between the recess 22 and the second end 28 of the plate 12. The indents 46 define a passageway through which a golf ball 14 rolls as a golfer attempts to hit the golf ball 14 from the first end 26 of the plate 12 toward the second end 28 of the plate 12, and out onto the putting surface along the intended alignment direction. The indents 46 are shaped and dimensioned such that obstacles 44 placed therein are readily dislodged when a struck golf ball 14 veers from the central groove 30 and strikes one of the obstacles 44.

Where a golfer hits a ball 14 such that it passes between the opposed obstacles 44, he or she knows the ball 14 was struck square and on-line. However, when the golf ball 14 strikes an obstacle 44, the golfer knows an error occurred during his or her putting stroke causing the ball 14 to roll left or right off course.

In accordance with a preferred embodiment of the present invention, the obstacles 44 are balls, for example, marbles, steel balls, or brass balls, which are maintained within the indents 46 until such a time that they are struck by a golf ball 14 passing thereby. While balls are used in accordance with a preferred embodiment of the present invention, other obstacles, for example, cylindrical posts, square blocks, nubs, etc. may be used.

As shown in the Figures, and in accordance with a preferred embodiment of the present invention, three indents 46 and three obstacles 44 may be respectively positioned on each side of the alignment groove 30. The obstacles 44 and indents 46 are positioned adjacent the second end 28 of the plate 12, a predetermined distance from the recess sufficient to test the putting skills of a golfer using the present putting trainer. In addition, the indents 46 taper inwardly as they extend toward the second end 28, thereby increasing the difficulty as obstacles 44 are positioned within different indents 46. While three sets of indents and obstacles are disclosed in accordance with a preferred embodiment of the present invention, more or less indents/obstacles may be employed without departing from the spirit of the present invention.

Referring to FIG. 1, a laser 48 may be used in conjunction with the present putting trainer 10 to ensure adequate alignment with a target 50 beyond the plate 12. The laser 48 is used by placing the laser 48 within the alignment groove 30 and allowing the laser 48 to direct a laser light toward, and onto, a target 50.

Figure 7A:
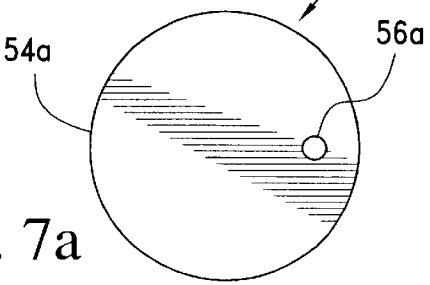
FIG. 7*a* is a top view of the alignment cam utilized in accordance with the present invention.
Figure 7B:
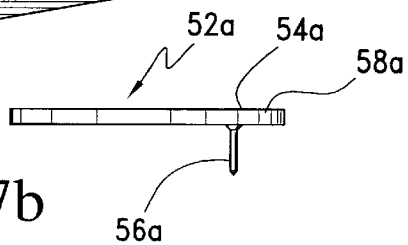
FIG. 7*b* is a side view of the alignment cam utilized in accordance with the present invention.
Figure 8:
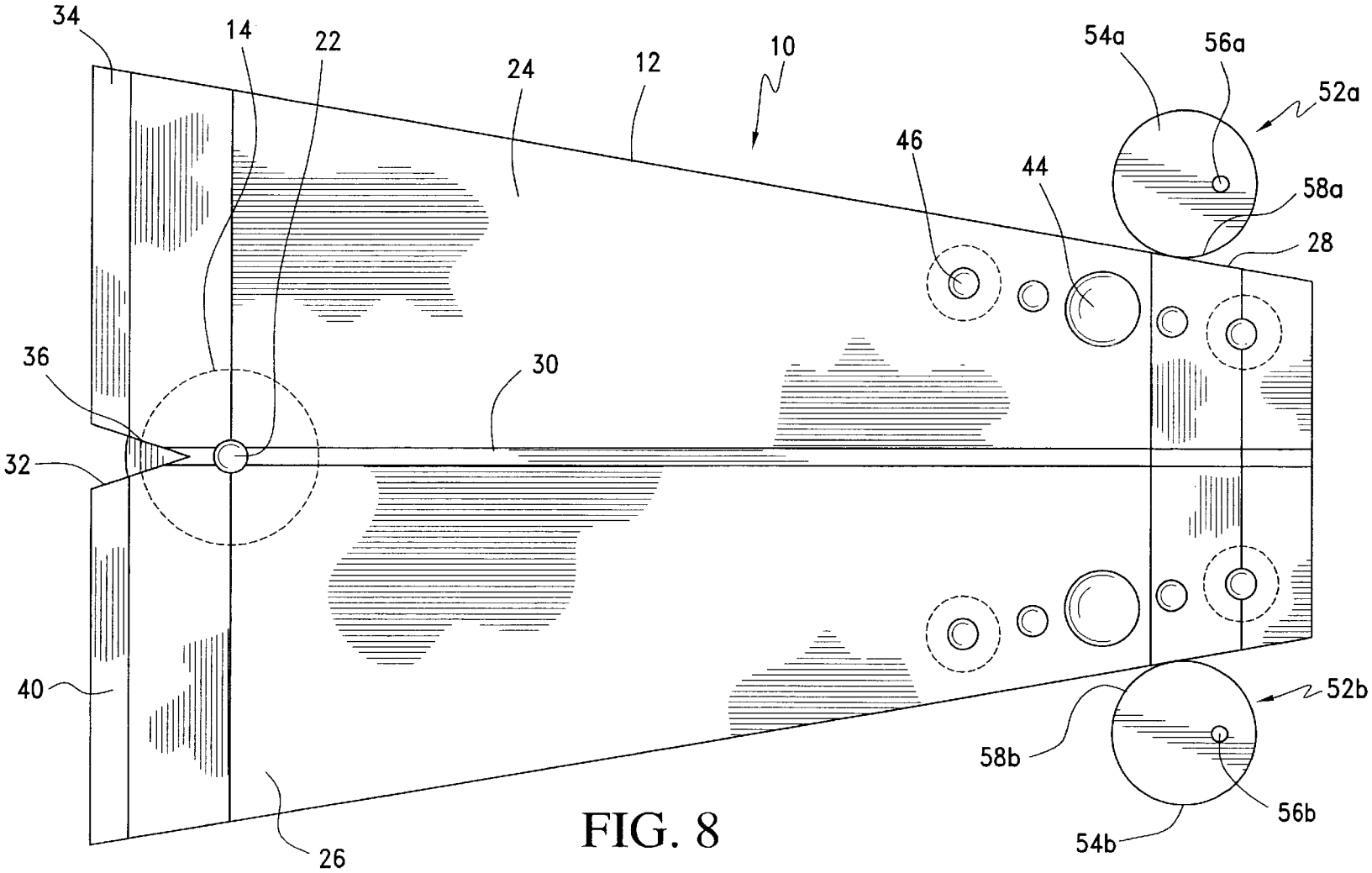
FIG. 8 is a top view of the putting trainer employing the alignment cams.

Referring to FIGS. 7*a*, 7*b* and 8, two precision alignment cams 52*a*, 52*b* may be used in conjunction with the present putting trainer 10. Each alignment cam 52*a*, 52*b* is composed of a circular disc 54*a*, 54*b* with an offset stake 56*a*, 56*b* extending downwardly therefrom. The alignment cam 52*a*, 52*b* further includes an edge 58*a*, 58*b* about its circumference, the edge 58*a*, 58*b* being shaped and dimensioned to engage the aiming plate 12 when utilized in the manner discussed below.

In use, the alignment cams 52*a*, 52*b* are positioned on either side of the plate 12 with the edge 58*a*, 58*b* of the respective alignment cams 52*a*, 52*b* in contact with the plate 12. When positioned in this way, the alignment cams 52*a*, 52*b* ensure the predetermined alignment of the plate 12 and restrict unwanted movement by the plate 12 when golf balls are struck and rolled along the putting plate.

When slight adjustment is required, the golfer can rotate one of the alignment cams 52*a*, 52*b* away from the edge of the plate 12. The alignment cam 52*a*, 52*b* is rotated by twisting the disc 54*a*, 54*b* about the stake 56*a*, 56*b* without the need for removing the alignment cam 52*a*, 52*b* from the support surface. The plate's 12 alignment is then adjusted in the desired direction by rotating the plate 12 about the downwardly extending stake 20. The golfer then rotates the second cam 52*a*, 52*b* such that its edge 58*a*, 58*b* is in contact with the plate 12 to "lock-in" the adjustment of the plate 12 and ensure the new alignment of the putting trainer 10.

In accordance with a preferred embodiment of the present invention, the plate is approximately 8.75 inches long and tapers from a width of 5.5 inches wide adjacent the first end to a width of 2.5 inches adjacent the second end. However, those skilled in the art will appreciate that these dimensions are merely exemplary and other dimensions may be employed without departing from the spirit of the present invention.

While the preferred embodiments have been shown and described, it will be understood that there is no intent to limit the invention by such disclosure, but rather, is intended to cover all modifications and alternate constructions falling within the spirit and scope of the invention as defined in the appended claims.

What is claimed is:

1. A putting trainer, comprising:

a substantially flat plate upon which a golfer may place and strike a golf ball, the plate including a first end having a recess shaped and dimensioned for receiving a golf ball and maintaining the golf ball in position adjacent the first end until such a time that the golfer strikes the golf ball toward a second end of the plate, the first end adjacent the recess being free of obstacles so as to not interfer with a golfer striking a ball toward the second end of the plate;

the plate further includes a central alignment groove extending from the recess toward the second end of the plate, the central alignment groove providing a desired alignment for a golfer striking a golf ball sitting within the recess; and a plurality of obstacles respectively and selectively positioned within a plurality of indents formed within the plate, the indents being positioned on opposite sides of the central alignment groove at positions adjacent the second end of the plate, remote from the area adjacent the first end where a golfer strikes a golf ball, to define a plurality of differently dimensioned passageways through which a golf ball is desirably struck as a golfer attempts to hit the golf ball from the first end of the plate toward the second end of the plate, wherein the indents are shaped and dimensioned such that obstacles placed therein are readily dislodged when a struck golf ball veers from the central alignment groove and strikes one of the obstacles.

2. The putting trainer according to claim 1, wherein the plurality of obstacles are balls.

3. The putting trainer according to claim 2, wherein the plurality of indents are dimples respectively shaped and dimensioned to receive the balls.

4. The putting trainer according to claim 1, wherein the first end includes a first edge adjacent the recess, the first edge being perpendicular to the central alignment groove and the recess being positioned relative the first edge such that a rear edge of a golf ball sitting within the recess is aligned with the first edge, allowing a golfer to align a putter with the first edge when the golfer addresses the golf ball prior to putting.

5. The putting trainer according to claim 4, wherein the recess is approximately 0.84 inches from the rear edge.

6. The putting trainer according to claim 1, wherein the central alignment groove is visible to a golfer.

7. The putting trainer according to claim 1, wherein the first end includes a first edge adjacent the recess, the first edge including an open cut section extending from the first edge toward the recess, the open cut section being defined by opposed upwardly inclined walls such that a ball rolled within the open cut section toward the recess will roll up the opposed upwardly inclined walls and into the recess.

8. The putting trainer according to claim 7, wherein the opposed upwardly inclined walls angle toward each other as they extend from the first edge toward the recess.

9. The putting trainer according to claim 8, wherein the opposed upwardly inclined walls define a substantially V-shaped open cut section.

10. A putting trainer, comprising:

a substantially flat plate upon which a golfer may place and strike a golf ball, the plate including a first end having a recess shaped and dimensioned for receiving a golf ball and maintaining the golf ball in position adjacent the first end until such a time that the golfer strikes the golf ball toward a second end of the plate;

wherein the first end includes a first edge adjacent the recess, the recess being positioned relative the first edge such that a rear edge of a golf ball sitting within the recess is aligned with the first edge, allowing a golfer to align a putter with the first edge as the golfer addresses the golf ball prior to putting, wherein the recess is approximately 0.84 inches from the first edge.

11. The putting trainer according to claim 10, wherein the first edge includes an open cut section extending from the first edge toward the recess, the open cut section being defined by opposed upwardly inclined walls such that a ball rolled within the open cut section toward the recess will roll up the opposed upwardly inclined walls and into the recess.

12. The putting trainer according to claim 11, wherein the opposed upwardly inclined walls angle toward each other as they extend from the first edge toward the recess.

13. The putting trainer according to claim 12, wherein the opposed upwardly inclined walls define a substantially V-shaped open cut section.

14. A putting trainer, comprising:

a substantially flat plate upon which a golfer may place and strike a golf ball, the plate including a first end having a recess shaped and dimensioned for receiving a golf ball and maintaining the golf ball in position adjacent the first end until such a time that the golfer strikes the golf ball toward a second end of the plate;

the plate further including a positioning stake extending downwardly from an underside of the plate adjacent the first end of the plate, the stake being positioned in alignment with the recess allowing the plate to be readily rotated about the stake and recess when a golfer wishes to realign a putting direction; and further including a pair of alignment cams shaped and dimensioned for positioning adjacent the plate for engaging sides of the plate so as to facilitate selective and secure orientation of the plate.

15. The putting trainer according to claim 14, wherein each alignment cam includes a circular body and an centrally offset, downwardly extending stake.

* * * * *